US010364588B2

(12) United States Patent
Krenzel

(10) Patent No.: US 10,364,588 B2
(45) **Date of Patent: *Jul. 30, 2019**

(54) SHELTER SYSTEM

(71) Applicant: Go Papa, LLLP, Littleton, CO (US)

(72) Inventor: Ronald L. Krenzel, Longmont, CO (US)

(73) Assignee: Go Papa, LLLP, Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/044,726

(22) Filed: Jul. 25, 2018

(65) Prior Publication Data

US 2018/0328072 A1 Nov. 15, 2018

Related U.S. Application Data

(63) Continuation of application No. 15/835,528, filed on Dec. 8, 2017, now Pat. No. 10,060,151, which is a continuation of application No. 15/275,600, filed on Sep. 26, 2016, now Pat. No. 9,869,110.

(60) Provisional application No. 62/233,504, filed on Sep. 28, 2015.

(51) Int. Cl.

| | |
|---|---|
| ***E04H 15/18*** | (2006.01) |
| ***E04H 15/46*** | (2006.01) |
| ***E04H 15/40*** | (2006.01) |
| ***E04H 15/50*** | (2006.01) |
| ***E04H 15/54*** | (2006.01) |
| ***E04H 15/64*** | (2006.01) |
| ***E04H 15/32*** | (2006.01) |

(52) U.S. Cl.

CPC ..... *E04H 15/18* (2013.01); *E04H 15/322* (2013.01); *E04H 15/40* (2013.01); *E04H 15/46* (2013.01); *E04H 15/50* (2013.01); *E04H 15/64* (2013.01)

(58) Field of Classification Search

CPC ..... E04H 15/18; E04H 15/322; E04H 15/40; E04H 15/46; E04H 15/50; E04H 15/60

USPC ..... 135/97, 115, 117, 119, 120.1, 120.3, 160

See application file for complete search history.

(56) References Cited

U.S. PATENT DOCUMENTS

| | | | | |
|---|---|---|---|---|
| 1,666,757 A | | 4/1928 | Snyder | |
| 1,884,449 A | | 10/1932 | Wickstrum | |
| 1,927,387 A | * | 9/1933 | Bixenstein | E04H 15/58 135/116 |

(Continued)

FOREIGN PATENT DOCUMENTS

| | | | | |
|---|---|---|---|---|
| CA | 2980077 A1 | * | 9/2016 | E04H 15/405 |
| DE | 1111786 B | * | 7/1961 | E04H 15/00 |

(Continued)

OTHER PUBLICATIONS

Ozark Trail 10 Person Cabin Tent <https://www.walmart.com/ip/Ozark-Trail-10-Person-3-Room-XL-Family-Cabin-Tent/22954579>, Aug. 10, 2016, 7 pp.

(Continued)

*Primary Examiner* — Robert Canfield

(74) *Attorney, Agent, or Firm* — Brooks, Cameron & Huebsch, PLLC

(57) ABSTRACT

A shelter system includes a shelter. A shelter includes a number of vertical support legs and a collapsible truss section interconnecting the vertical support legs. The shelter system includes a canopy secured to the shelter. The shelter system includes a connection member connecting the canopy to a separate self-supporting tent structure.

20 Claims, 6 Drawing Sheets

(56) References Cited

U.S. PATENT DOCUMENTS

| | | | | |
|---|---|---|---|---|
| 2,137,625 | A | 11/1938 | Norvell | |
| 2,513,729 | A | 7/1950 | Lemen | |
| 2,928,403 | A | 3/1960 | Hoskins | |
| 2,935,074 | A * | 5/1960 | Baker | E04H 15/28 135/117 |
| D224,850 | S * | 9/1972 | Enzel et al. | D21/838 |
| 3,699,986 | A | 10/1972 | Kirkham | |
| 3,756,649 | A | 9/1973 | Wines | |
| 3,874,396 | A | 4/1975 | Kirkham | |
| 4,102,352 | A | 7/1978 | Kirkham | |
| 4,641,676 | A | 2/1987 | Lynch | |
| 4,793,371 | A | 12/1988 | O'Ferrell | |
| 4,941,500 | A | 7/1990 | Emard | |
| 4,947,884 | A | 8/1990 | Lynch | |
| 5,117,853 | A | 6/1992 | Pruesner | |
| 5,394,897 | A | 3/1995 | Ritchey et al. | |
| 5,441,069 | A | 8/1995 | Moss | |
| 5,490,532 | A | 2/1996 | Mallookis et al. | |
| D369,638 | S * | 5/1996 | Smith | D21/834 |
| 5,634,483 | A | 6/1997 | Gwin | |
| 5,641,192 | A | 6/1997 | Smith et al. | |
| 5,669,655 | A * | 9/1997 | Hammond | B60J 1/2011 296/165 |
| 6,273,114 | B1 | 8/2001 | Schaefer | |
| 6,357,462 | B1 | 3/2002 | Laosunthara et al. | |
| D470,560 | S | 2/2003 | Han | |
| 6,666,223 | B2 | 12/2003 | Price et al. | |
| 7,040,333 | B1 | 5/2006 | Ransom et al. | |
| 7,588,045 | B2 | 3/2009 | Goodwin et al. | |
| D624,623 | S * | 9/2010 | Viglione | D21/839 |
| 8,001,987 | B2 | 8/2011 | Williams | |
| D652,885 | S | 1/2012 | Frey | |
| 8,132,584 | B2 | 3/2012 | Lane et al. | |
| 3,316,508 | A1 | 11/2012 | Lapping | |
| D692,083 | S | 10/2013 | Toland | |
| 8,763,621 | B2 | 7/2014 | Jin | |
| 8,776,815 | B2 | 7/2014 | Park et al. | |
| 9,470,010 | B2 | 10/2016 | Youn | |
| D779,611 | S | 2/2017 | Seddon | |
| 2002/0104561 | A1 | 8/2002 | Carter | |
| 2004/0238021 | A1 | 12/2004 | Holub et al. | |
| 2005/0189009 | A1 | 9/2005 | Walter | |
| 2005/0205124 | A1 | 9/2005 | Goldwitz | |
| 2006/0096631 | A1 | 5/2006 | Mallookis et al. | |
| 2006/0118155 | A1 | 6/2006 | Carter | |
| 2007/0251562 | A1 | 11/2007 | Carter | |
| 2009/0056781 | A1 | 3/2009 | Stanley et al. | |
| 2009/0065037 | A1 | 3/2009 | Hauschild et al. | |
| 2009/0250089 | A1 | 10/2009 | Carter | |
| 2010/0180923 | A1 | 7/2010 | Carter | |
| 2011/0048483 | A1 | 3/2011 | Carter | |
| 2011/0232712 | A1 | 9/2011 | Carter | |
| 2012/0211041 | A1 | 8/2012 | Carter | |
| 2013/0061896 | A1 | 3/2013 | Webster | |
| 2015/0337557 | A1 | 11/2015 | Youn | |

FOREIGN PATENT DOCUMENTS

| | | | | |
|---|---|---|---|---|
| DE | 29517290 | U1 | 12/1995 | |
| FR | 2898928 | A1 * | 9/2007 | E04H 15/06 |
| JP | 10037535 | A | 2/1998 | |
| WO | WO-2010107889 | A1 * | 9/2010 | E04H 15/008 |
| WO | 2014076384 | A1 | 5/2014 | |

OTHER PUBLICATIONS

Ozark Trail 10-Person 3-Room Vacation Tent with Built-In Mud Mat, from Walmart.com, 11 pp. Sep. 26, 2016.

Ozark Trail 12-Person 2 Room Instant Cabin Tent with Screen Room, from Walmart.com, 7 pp. Sep. 26, 2016.

* cited by examiner

SHELTER SYSTEM

PRIORITY INFORMATION

This application is a Continuation of U.S. application Ser. No. 15/835,528, filed Dec. 8, 2017, which is a Continuation of U.S. application Ser. No. 15/275,600 filed Sep. 26, 2016, now U.S. Pat. No. 9,869,110, which claims benefit of U.S. Provisional Application No. 62/233,504, filed Sep. 28, 2015 the specification of which is incorporated herein by reference.

BACKGROUND OF THE INVENTION

Portable collapsible shelters, e.g., collapsible frame folding canopies, are in widespread use. These shelters are common at beaches, sporting events, farmers markets, weddings, graduations and other outdoor and indoor events. Collapsible shelters may provide portable, easily erectable, and durable shelters for varied purposes.

Portable collapsible shelters can include accordion-type collapsible truss assemblies between vertical supporting legs (e.g., telescoping, collapsible vertical support legs) of the shelter frame. Accordion-type collapsible truss assemblies can include a number of truss members interconnected at pivotal x-joints near truss member midpoints and at pivotal v-joints near truss member endpoints. The truss members may be connected at one endpoint to a portion of a vertical support leg, e.g., at a slidable or fixed mounting bracket, and at another endpoint to another truss member at a pivotal v-joint. Thus, the accordion-type collapsible truss assembly can be expanded and collapsed to allow for ease of transport, setup, and takedown.

Truss assemblies for portable collapsible shelters were previously composed of thick walled steel tubing, or solid piping. To increase portability of collapsible shelters, some manufacturers have used lighter weight and lower strength materials, e.g., aluminum for example, in truss assemblies of collapsible shelters. To limit weight and cost, some manufacturers have also used thin walled truss members in portable collapsible assemblies. Manufacturers may incorporate canopies into their portable collapsible shelters.

In contrast, tent structures may be utilized as portable self-supporting tent shelters. For example, tent structures (e.g., pop up tents) may be utilized as portable self-supporting temporary structures when engaging in recreational activities such as camping. Tent structures may include sheets of fabric or other material draped over and/or attached to a frame of support poles. In many cases the support poles of a self-supporting tent are flexible and pliable, e.g., fiberglass. The support poles may be flexible, yet provide enough rigidity to maintain the shelter in an erect configuration suitable for occupation. The support poles may also be lightweight and compact for easy storage and hauling. For example, a tent structure may be attached to a frame of fiberglass tent poles. Tent structures may also be attached to a supporting and/or anchoring rope, such as a guy line tied to stakes or tent pegs.

Tent structures may include a variety of geometries. For example, a tent structure may include a ridge tent or A-frame geometry having an elongated triangular shape supported by a pole at each end and a cross pole between the end poles. A tent structure may include a dome geometry where the number of sides of the dome may be dictated by the number of flexible supporting poles flexed into a half circle. The tent structure may include a geodesic or semi-geodesic geometry utilizing crisscrossing flexible poles intersecting to form triangles. A tent structure may include a hoop tent having a number of curved poles at either end to help retain shape with a number of arched interior frames.

Popular tent structures have geometries and dimensions intended to be compact and lightweight. The geometries and dimensions are intended to accommodate sleeping or sitting within the tent. However, the geometries and dimensions are not intended for standing underneath the tent structures.

DETAILED DESCRIPTION

Figure 1:
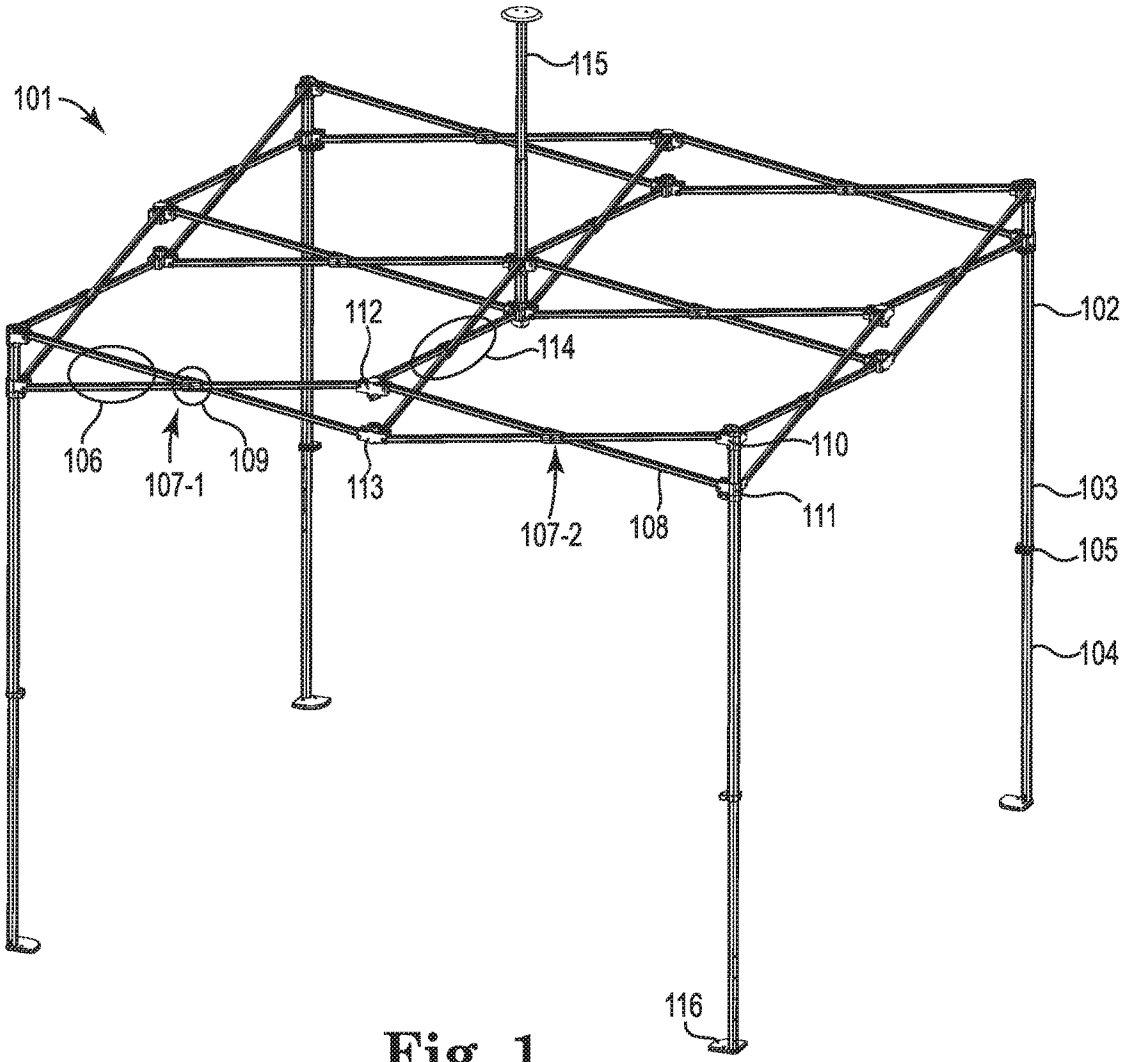
FIG. 1 illustrates a perspective view of a collapsible shelter frame according to an embodiment of the present disclosure.

The present disclosure includes a shelter system including a shelter. The shelter may be a collapsible shelter. The collapsible shelter may include a collapsible shelter frame. The collapsible shelter frame may include a number of vertical support legs and a collapsible truss section interconnecting the number of vertical support legs. The collapsible shelter may include a canopy secured to the collapsible shelter frame and a connection member to connect the canopy to a separate self-supporting tent structure. The collapsible shelter system may be configured for the construction of a modular multiple-unit structure by connecting a collapsible shelter to a separate self-supporting tent structure.

The shelter system may be configured to mate a third party self-supporting tent structure, after purchase, with a collapsible shelter. The shelter system may be configured to mate self-supporting tent structure having a variety of geometries, from a variety of manufacturers or distributors, and/or purchased at a variety of retailers to a collapsible shelter. In this manner, the shelter system may be connected to a plurality of self-supporting tent structures to expand an available usable area.

The present disclosure describes a shelter system that provides connections that may improve the appearance of a self-supporting tent structure. For example, a collapsible shelter, independently or in combination with a self-supporting tent structure may offered increased aesthetics over the appearance of the self-supporting tent structure alone.

The present disclosure describes a shelter system that may provide a user of a self-supporting tent structure increased utility when camping. For example, by connecting a collapsible shelter to the self-supporting tent structure, a self-supporting tent structure user may be able to utilize the increased space and/or head clearance associated with a collapsible shelter connected to the self-supporting tent structure via the connection member. A self-supporting tent structure user may be able to utilize the space of the collapsible shelter while still being sheltered from outside elements and without having to pass outside to utilize the space of the multiple-units. Additionally, the shelter system may allow the user to utilize the area within the collapsible shelter as a type of sheltered foyer area connected to the self-supporting tent structure while still being able to pass into the self-supporting tent structure without passing outdoors and being able to close off the self-supporting tent structure from the collapsible shelter for privacy. The self-supporting tent structure may also be rapidly disconnected from the collapsible shelter if the connection is no longer desired and/or for transport.

The present disclosure describes a shelter system that may serve as a conduit between a plurality of self-supporting tent structures. In this manner, the collapsible shelter system may serve as a common area linking the self-supporting tent structures with a space sheltered from outside elements. In some examples, the collapsible shelter may serve as an upright gathering area to stand for inhabitants of the self-supporting tent structures while still preserving the option of sealing off the self-supporting tent structures from the common area of the collapsible shelter for privacy without disconnecting the connection between the collapsible shelter and the self-supporting tent structures.

The present disclosure describes a shelter system that may, by connecting a self-supporting tent structure to a collapsible shelter increase the resistance of one or both of the structures to environmental conditions such as wind. For example, connecting the self-supporting tent structure to a collapsible structure may increase an exterior surface area of the structures. The increased exterior surface are may be more resistant to environmental conditions such as wind gusts. For example, an environmental condition such as a wind gust may exert force on the collapsible shelter and/or the tent structure. The force may be dissipated across the respective structures of the collapsible shelter and/or the tent structure. The force may be dissipated across the exterior surface area. A larger continuous exterior surface area associated with the connected collapsible shelter and the tent structure may allow for increased dissipation of the forces exerted during the application of an environmental condition. The present disclosure describes a shelter system that incorporates distinct structures with distinct support mechanisms that may collectively brace against environmental conditions without intertwining the distinct support mechanisms. In an example, where a force associated with an environmental condition will be exerted on the smaller, lightweight support system of the self-supporting tent structure alone, application of the described shelter system may allow dissipation of the force across the sturdier and heavier support legs and truss system of the collapsible shelter. Additionally, complementary geometries of the collapsible shelter and/or the tent structure may be utilized to distribute the forces associated with environmental conditions.

The present disclosure describes a shelter system that may connect a collapsible shelter and a self-supporting tent structure without alteration to the support structure of either of the collapsible shelter and the self-supporting tent structure. The present disclosure describes a connection member that is able to connect a collapsible shelter to a wide variety of existing self-supporting tent structures without requiring additional equipment or alteration of the self-supporting tent structure.

In the following detailed description of the present disclosure, reference is made to the accompanying drawings that form a part hereof, and in which is shown by way of illustration how a number of embodiments of the disclosure may be practiced. These embodiments are described in sufficient detail to enable those of ordinary skill in the art to practice the embodiments of this disclosure, and it is to be understood that other embodiments may be utilized and that structural changes may be made without departing from the scope of the present disclosure. As used herein, "a number of" something can refer to one or more of such things. For example, a number of vertical support legs can refer to one or more vertical support legs.

FIG. 1 illustrates a perspective view of a collapsible shelter frame 101 according to an embodiment of the present disclosure. The collapsible frame 101 has four vertical support legs 102 at spaced peripheral intervals. In a number of embodiments, the collapsible frame 101 can have any number of vertical support legs at spaced peripheral intervals. Each vertical support leg 102 can have an upper and lower telescoping members 103 and 104 which can be connected with an adjustable locking member 105 to regulate a length of extension. In a number of embodiments, the vertical support legs 102 can be of any suitably shaped cross-section and can be comprised of any number of telescoping members. In some embodiments, the vertical support legs may also incorporate other mechanisms of extension and collapse (e.g. folding, detachable assembly, etc.). As depicted, the collapsible frame 101 has outer peripheral truss sections 106 made up of two pair, e.g. 107-1 and 107-2, of upper and lower scissors-like pivotal truss arm members 108, each pair interconnected at pivotal x-joints 109. The truss sections are connected in end-to-end relation to one another by upper and lower intermediate mounting members 112 and 113 between adjacent upper and lower corner mounting members 110 and 111 attached to vertical support legs 102 of the collapsible frame 101. Radial truss sections 114 extend between ends of the truss members 108 attached to a center support tube 115 and ends of the truss arm members 108 attached the upper and lower intermediate mounting members 112 and 113 of each outer peripheral truss section 106, respectively. In other embodiments, the collapsible frame 101 and peripheral truss sections 106 may include other collapsible architectures, e.g. geodesic domes, grid shell structures, cathedral style structures, marquee structures, etc., as the same will be understood by those of skill in the art.

Each vertical support leg 102 may include a foot plate 116. The foot plate 116 may be located distal to the truss sections 106. For example, the foot plate 116 may be located on a distal end of a vertical support leg 102 opposite an end upon which the upper corner mounting member 110 is located. The foot plate 116 may include a quarter circle and/or pie shaped wedge of material with at least one flat surface having a surface area larger than that of the distal end of vertical support leg 102 and configured to rest on a ground surface. The foot plate 116 may include a hole or other opening through the flat surface configured to receive an anchor post configured to be driven into the ground surface beneath the foot plate 116. The flat surface of the foot plate 116 may be perpendicular to the vertical length of the vertical support leg 102.

Figure 2:
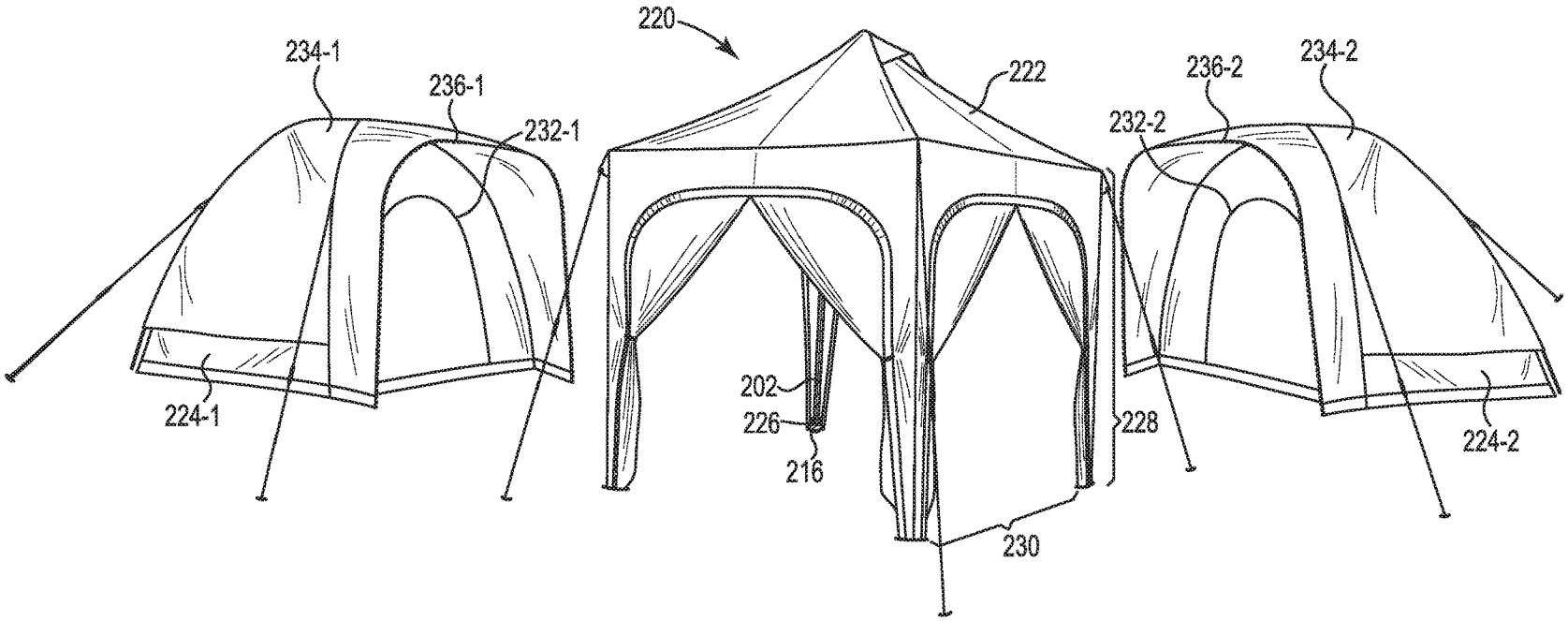
FIG. 2 illustrates a perspective view of a collapsible shelter frame with a canopy attached and neighboring separate self-supporting tent structures.

FIG. 2 illustrates a perspective view of a collapsible shelter frame with a canopy attached and neighboring separate self-supporting tent structures. A collapsible shelter 220 may include a collapsible a canopy 222 attached to a collapsible frame (e.g., collapsible frame 101 illustrated in FIG. 1). The canopy 222 may be attached at various points to the collapsible frame. For example, the canopy 222 may be attached to the outer peripheral truss sections 106 illustrated in FIG. 1 and/or to upper and/or lower intermediate mounting members 112 and 113 illustrated in FIG. 1. The canopy 222 may be supported by the center support pole 115 and may cover and/or wrap around the exterior of the outer peripheral truss sections 106 illustrated in FIG. 1.

The canopy 222 may include a leg spanning portion 228. The leg spanning portion 228 of the canopy 222 may extend continuously along the vertical support leg 202 from the truss sections 106 illustrated in FIG. 1 to a foot plate 216. For example, the canopy 222 may have four leg covering portions represented by the leg spanning portions 228. The leg spanning portions 228 may cover each vertical support leg 202 obstructing the vertical support legs from direct view from outside of the collapsible frame. The canopy 222 may be releasably engageable with the vertical support legs 202. The canopy may be releasably engageable with the vertical support legs 202 via an attachment means 226 releasably connecting the canopy 222 to each vertical support leg 202. In one example, the attachment means 226 may include a retention strap. The attachment means 226 may be anchored to an end of the leg spanning portion 228 of the canopy 222 that is furthest distal from the outer peripheral truss sections 106 utilizing an engagement with an anchor post.

In various embodiments, the canopy 222 is releasably engageable with the foot plate 216. For example, a leg spanning portion 228 may be releasably engageable with the foot plate 216 at a distal end of the vertical support leg 202. The canopy 222 may include a releasable engagement mechanism engageable with the foot plate 216. In an example, an end of the leg spanning portion 228 of the canopy 222 that is furthest distal from the outer peripheral truss sections 106 of FIG. 1 may include a retention plate. The retention plate may be tucked under the foot plate 216 and held in place by the pressure exerted from the weight of the collapsible shelter 220 resting on the retention plate. Additionally, an anchor post traversing the foot plate 216 and the retention plate may be utilized to hold the retention plate in place. By releasably engaging the foot plate 216, the canopy 222 may remain tautly fit around the outside of the collapsible frame. In the same manner the canopy 222 may remain held securely in place such that environmental conditions such as wind gusts are not able to lift the canopy 222 off or away from the collapsible frame or cause the canopy 222 to flap in the breeze leading to a premature weathering and/or degradation of the canopy 222.

Additionally, releasable engagement of the canopy 222 with the foot plate 216 and/or the vertical support leg 202 may facilitate retention of an arcuate opening 230 in the canopy 222 between each pair of vertical support legs 102. The arcuate opening 230 may span, on one side of the collapsible frame, from a distal end (e.g., starting at foot plate 216) of a first vertical support leg to a distal end of an adjacent second vertical support leg. For example, releasable engagement of the canopy 222 with the foot plate 216 and/or the vertical support leg 202 may provide substantially consistent tension across the portions of the canopy 222 defining the arcuate opening 230. Maintaining substantially consistent tension across the portions of the canopy 222 defining the arcuate opening 230 may include maintaining substantially consistent tension across an arcuate interface of the canopy 222 skirting the portion of the canopy 222 defining the arcuate opening 230. The releasable engagement of the canopy 222 with the foot plate 216 and/or the vertical support leg 202 may maintain a consistent tension and taut fit of the leg spanning portion 228 along the vertical support leg 202 when the collapsible shelter 220 is erect.

A self-supporting tent structure 224-1 and 224-2 may include a tent structure that is a stand-alone structure distinct from the collapsible shelter 220. The self-supporting tent structure 224-1 and 224-2 may include a separate and distinct supporting substructure from the collapsible shelter's 220 supporting substructure. For example, the self-supporting tent structure may include tent poles running through sleeves fastened to the self-supporting tent structure. The tent poles may be distinct from, separate from, and non-intertwined with the supporting structure of the collapsible frame 101 illustrated in FIG. 1.

Additionally, the self-supporting tent structure 224-1 and 224-2 may include an anchoring system distinct from an anchoring system of the collapsible shelter 220. For example, the self-supporting tent structure 224-1 and 224-2 and the collapsible shelter 220 may utilize separate anchor points, anchor posts, and/or anchoring guy lines.

The tent structure 224-1 and 224-2 may have a distinct geometry from the geometry of the collapsible shelter 220. For example, the collapsible shelter 220 may have a cathedral geometry whereas the tent structure 224-1 and 224-2 may have a dome tent geometry.

The self-supporting tent structure 224-1 and 224-2 may include a door flap 232-1 and 232-2. A door flap 232-1 and 232-2 may be opened and/or closed. When the door flap 232-1 and 232-2 is open the resulting portal may be utilized as an entrance and/or an exit into the inner compartment of the 224-1 and 224-2. When the door flap 232-1 and 232-2 is closed and/or fastened the door flap 232-1 and 232-2 may function as a privacy screen and/or an insect screen, window, and/or a door between the tent structure 224-1 and 224-2 and the outside environment.

The connection members 234-1 and 234-2 may include a tent flysheet. A tent flysheet may include a fitted outer skin of the self-supporting tent structure 224-1 and 224-2. The tent flysheet may provide a protective barrier from the environmental conditions such as water, dew, wind, etc. The tent flysheet may have a coating such as a hydrophobic water repellant coating that causes water to form small droplets that bead and run off the self-supporting tent structure 224-1 and 224-2. The tent flysheet may prevent the environmental conditions from penetrating the inner skin of the self-supporting tent structure 224-1 and 224-2. Therefore, when secured in place, the connection members 234-1 and 234-2 may prevent the introduction of moisture and/or other environmental conditions into the self-supporting tent structure 224-1 and 224-2.

The connection members 234-1 and 234-2 may include a tent flysheet tensioning mechanism such as guy lines. The tent flysheet tensioning mechanism may be configured to maintain the connection members 234-1 and 234-2 tautly fitted over the surface of the self-supporting tent structure 224-1 and 224-2. The tent flysheet tensioning mechanism may be adjustable to prevent and/or compensate for overstretching of the connection members 234-1 and 234-2. Maintaining a taut fit of the connection members 234-1 and 234-2 over the surface of the self-supporting tent structure 224-1 and 224-2 may prevent damage to the tent from flapping in the wind and/or to prevent moisture permeation into the self-supporting tent structure 224-1 and 224-2. The connection members 234-1 and 234-2 may function as a breathable water repellant roof of a separate self-supporting tent structure 224-1 and 224-2.

The connection members 234-1 and 234-2 may include a connection member interface 236-1 and 236-2. The connection member interface 236-1 and 236-2 may be configured to releasably engage a complementary canopy interface (not visible in illustration) along the inside edge of the portion of the canopy 220 defining the perimeter of the arcuate opening 230. For example, the connection member interface 236-1 and 236-2 may include a first portion 237-1 and a second portion 237-2. The first portion 237-1 and the second portion 237-2 may include zipper interfaces configured to zip together with and provide releasable engagement to a canopy interface.

Figure 3A:
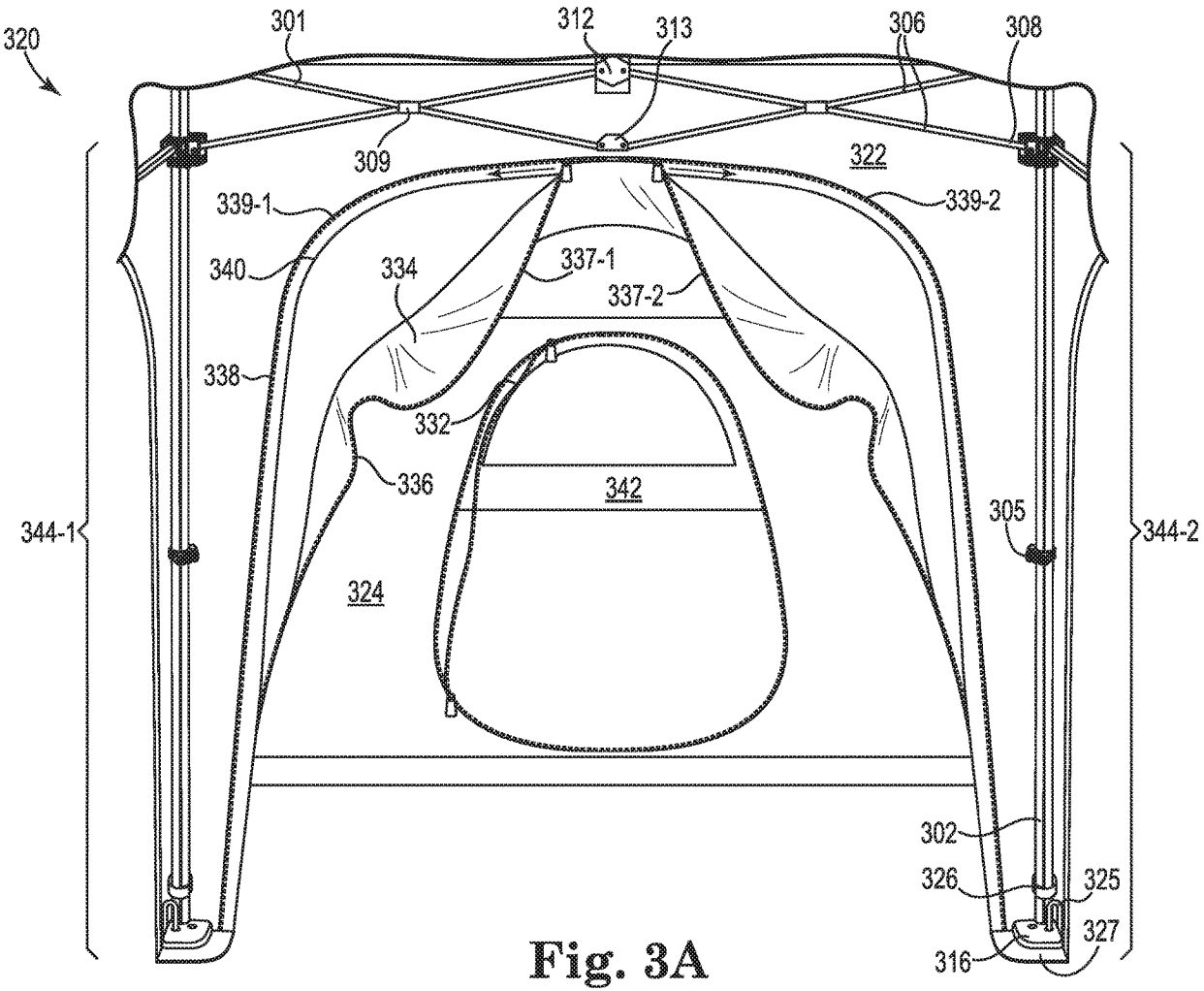
FIG. 3A illustrates a perspective view of an interior of a collapsible shelter with a partially engaged connection member and a separate self-supporting tent structure.

FIG. 3A illustrates a perspective view of an interior of a collapsible shelter 320 with a partially releasably engaged connection member 334 and a separate self-supporting tent structure 324. The collapsible shelter 320 may be supported by the collapsible frame 301. The collapsible frame 301 may include a vertical support leg 302, foot plate 316, truss sections 306, truss members 308, truss sections 306, upper and lower intermediate mounting members 312 and 313, upper and lower scissors-like pivotal truss arm members 308, each pair interconnected at pivotal x-joints 309. The collapsible shelter 320 may include attachment means 326, retention plates 327, anchor posts 325, and a canopy 322.

The self-supporting tent structure 324 may be a separate structure from the collapsible shelter 320. The self-supporting tent structure 324 may be supported entirely independent from the collapsible shelter 320 and/or the collapsible shelter's collapsible frame. The separate self-supporting tent structure 324 may include and interior compartment 342 (e.g., sleeping compartment) separated from the exterior environment by at least a fabric shell. The fabric shell may be ventilated. The fabric shell may be supported by a support structure (e.g., tent poles, guy lines, tent stakes, etc.) entirely separate from the collapsible frame or any other portion of the collapsible shelter 320.

The self-supporting tent structure 324 may include a door flap 332. The door flap 332 may be opened or closed (e.g., via a zipper mechanism) creating a portal from the interior compartment 342 to the exterior environment or closing off the interior compartment 342 from the exterior environment. The door flap 332 may have dimensions that smaller than the dimensions of a face of a side of the self-supporting tent structure 324 upon which the door flap 332 is positioned. The door flap 332 and/or the opening that it covers is not limited to any particular geometry and the illustrated geometry is one of many suitable geometries.

The connection member 334 may be a separate member from both the self-supporting tent structure 324 and the collapsible shelter 320. The connection member 334 may include a tent flysheet. A tent flysheet may include a fitted outer skin of the self-supporting tent structure 224-1 and 224-2 providing a protective barrier from the environmental conditions such as water, dew, wind, etc. The connection member 324 may encompass an upper portion of the self-supporting tent structure 324 in its function as a tent flysheet. The connection member 334 may include a connection member interface 336. The connection member interface 336 may include a first portion 337-1 and a second portion 337-2. The connection member interface 336 may be arcuate shaped with each portion making up half of an arcuate geometry. The connection member interface 336 may be configured to releasably engage a canopy interface 338 (e.g., via a zipper mechanism, a strap mechanism, a hook-and-loop fastener mechanism, a buckle mechanism, a clip mechanism, a button mechanism, etc.). The first portion 337-1 and the second portion 337-2 of the connection member interface 336 may include separately actuated mechanisms to achieve releasable engagement with a respective one of a first 339-1 portion and a second portion 339-2 of the canopy interface 338. For example, the connection member interface 336 may include a zipper mechanism where the first portion 337-1 and the second portion 337-2 are releasably engageable with a complementary first portion 339-1 and a second portion 339-2 of the canopy interface 338 utilizing separate zipper sliders, with separate zipper stops to releasably engage or separate zipper teeth. The first portion 337-1 and the second portion 337-2 of the connection member interface 336 being distinctly releasably engageable with a respective one of a first 339-1 portion and a second portion 339-2 of the canopy interface 338 may allow for distribution of a force load associated with joining the connection member interface 336 and the canopy interface 338. Utilizing two distinct portions of the connection member interface 336 and/or the canopy interface 338 may allow for the force load to be halved among the portions. Reducing the force load associated with releasably engaging the connection member interface 336 to the canopy interface 338 by leveraging the mechanical advantage of the two distinct zippers may allow the application of less force by the user and less strain on the components than if a single zipper was employed.

The collapsible shelter 320 may include a canopy 322. The canopy 322 may be mounted on the collapsible frame 301. The canopy 322 may be configured as a roof structure of the collapsible shelter 320. The canopy 322 may include a number of vertical support leg spanning portions 344-1 and 344-2. The number of vertical support leg spanning portions 344-1 and 344-2 may extend the canopy 322 along a vertical support leg 302 down to a foot plate 316 and/or just below a foot plate 316 distal to the truss sections 306. The number of vertical support leg spanning portions 344-1 and 344-2 may include a terminus proximal the foot plate 316.

The number of vertical support leg spanning portions 344-1 and 344-2 may be releasably engaged with the vertical support leg 302 and/or the foot plate 316. For example, the number of vertical support leg spanning portions 344-1 and 344-2 may be releasably engaged with the vertical support leg 302 and/or the foot plate 316 utilizing an attachment means 326. The attachment means 326 may include a semi-rigid retention strap that is connected (e.g., sewn and/or adhered) to an interior surface of the vertical support leg spanning portions 344-1 and 344-2. The attachment means 326 may encompass a vertical support leg 302. The attachment means 326 may include two portions that are joined together by a button mechanism or complementary hook-and-loop fastener portions. An anchor post 325 may be utilized to anchor the collapsible frame 301 into the ground. The anchor post 325 may be driven into the ground through a complementary opening in the foot plate 316. The anchor post 325 may, at an end opposite the end driven into the ground through the foot plate 316, have a looped or hooked portion. The attachment means 326 may be held in place by routing the attachment means 326 through the loop or hook portion of the anchor post 325. Alternatively, the attachment means 326 may only wrap around the vertical support leg 302 and avoid attachment with the anchor post 325.

Additionally, the number of vertical support leg spanning portions 344-1 and 344-2 may be releasably engaged with the vertical support leg 302 and/or the foot plate 316 by a retention plate 327. A retention plate 327 may be a substantially flat plate that is configured to slide under the foot plate 316. The retention plate 327 may have a larger foot print than the foot plate 316. The retention plate 327 may be a nylon based semi-flexible sheet of material. The vertical support leg spanning portions 344-1 and 344-2 may be connected (e.g., sewn and/or adhered) to the retention plate 327. In addition to a frictional and/or press fit between the foot plate 316 and the ground, the retention plate 327 may be held in place by the anchor post 325 described above. For example, the retention plate 327 may include complementary openings to those in the foot plate 316 and the anchor post 325 may be driven into the ground through the openings in the foot plate 316 and the anchor post 325.

The canopy 322 may be drawn taut and held secure to the collapsible frame 301 by the attachment means 326 and/or the retention plate 327. For example, the canopy 322 may be drawn taut in order to fit the attachment means 326 and/or the retention plate 327 into place around the collapsible frame 301 and the attachment means 326 and/or the retention plate 327 may maintain tension across the surface of the canopy 322 once held in place. In the same manner, the attachment means 326 and/or the retention plate 327 may maintain tension across the first portion 339-1 and the second portion 339-2 of the canopy interface 338. An arcuate geometry may be maintained across the canopy interface 338 by virtue of the forces maintained by the attachment means 326 and/or the retention plate 327 connections. The arcuate geometry under tension may allow for a robust and easily actuated connection between the connection member interface 336 and the canopy interface 338.

The canopy 322 may form an arcuate opening on each side of the collapsible shelter 320 bordered and/or defined by an arcuate trim flap 340. The trim flap 340 may cover, hide from view, and/or protect from environmental conditions, the first portion 339-1 and the second portion 339-2 of the canopy interface 338.

The first portion 339-1 and the second portion 339-2 of the canopy interface 338 may be recessed with respect to the trim flap 340, but may retain a substantially identical arcuate geometry to the trim flap 340. The first portion 339-1 and the second portion 339-2 of the canopy interface 338 may include complementary releasable engagement mechanisms to those of the connection member interface 336.

Figure 3B:
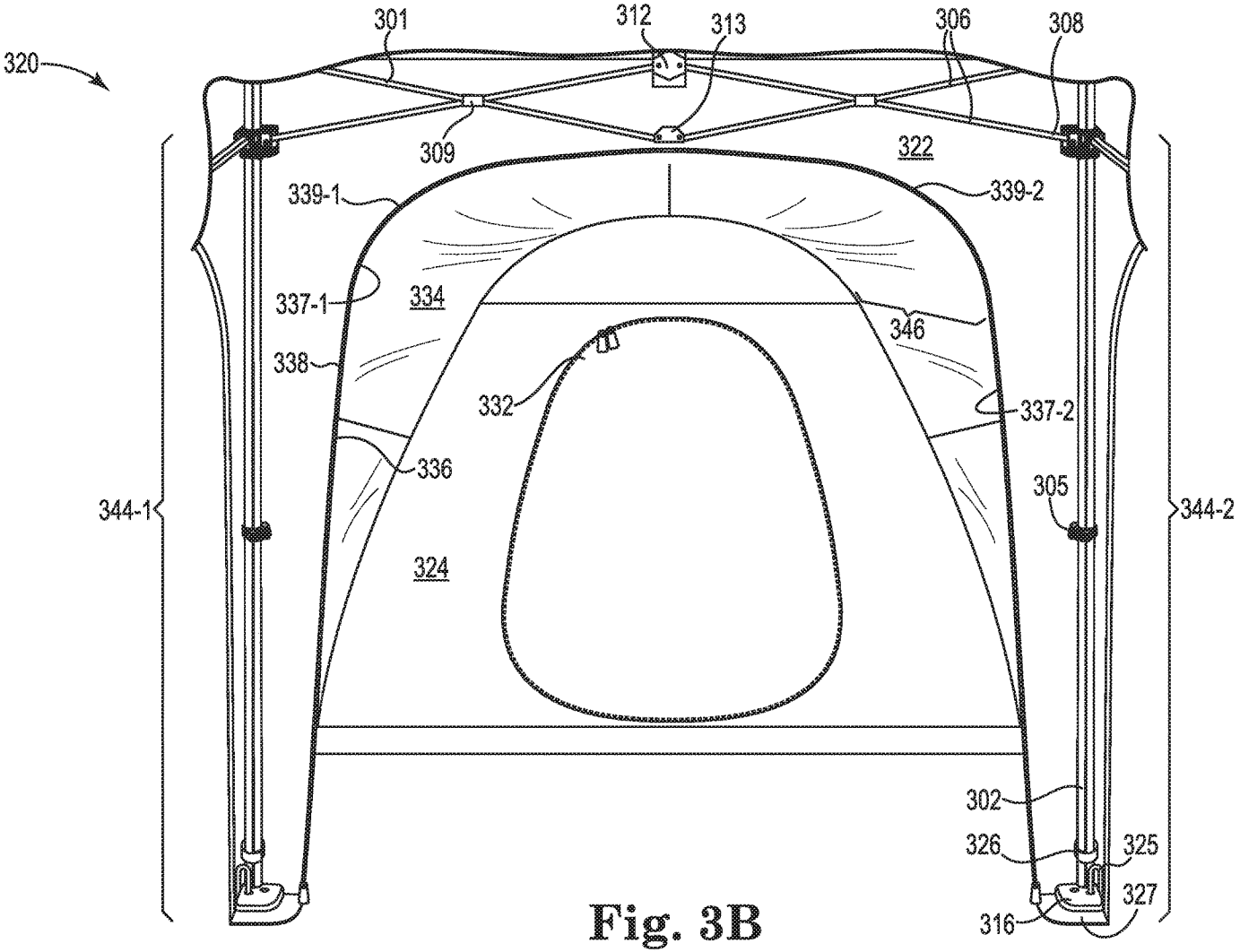
FIG. 3B illustrates a perspective view of an interior of a collapsible shelter with a releasably engaged connection member and a separate self-supporting tent structure.

FIG. 3B illustrates a perspective view of an interior of a collapsible shelter 320 with a fully releasably engaged connection member 334 and a separate self-supporting tent structure 324. The collapsible shelter 320 may be supported by a collapsible frame 301. The collapsible frame 301 may include vertical support legs 302, foot plates 316, truss sections 306, truss members 308, upper and lower intermediate mounting members 312 and 313, upper and lower scissors-like pivotal truss arm members 308, each pair interconnected at pivotal x-joints 309. The collapsible shelter 320 may also include attachment means 326, retention plate 327, anchor post 325, and/or canopy 322.

The connection member 334 is illustrated fully releasably engaged with the canopy 322. For example, the connection member 334 may be fully releasably engaged continuously along the canopy interface 338. The first portion 337-1 and the second portion 337-2 of the connection member interface 336 may be continuously engaged with the first portion 339-1 and the second portion 339-2 of the canopy interface 338, respectively. When the first portion 337-1 and the second portion 337-2 of the connection member interface 336 are continuously engaged with the first portion 339-1 and the second portion 339-2 of the canopy interface 338, respectively, the connection member 334 may be form-fit tautly to the surfaces of the self-supporting tent structure 324. However, the form-fit connection member 334 may not fit tautly to every surface of the self-supporting tent structure 324. For example, the connection member 334 may not fit tautly across the surface of the self-supporting tent structure that includes the door flap 332. Instead, the connection member 334, especially the extension portion 346 of the connection member 334, may loosely hang over the portion of the surface of the self-supporting tent structure 324 that includes the door flap 332 when not engaged with the canopy 322. However, the connection member extension portion 346 may form a roofed passageway between the door flap 332 of the self-supporting tent structure 324 and the collapsible shelter 320 when the connection member extension portion 346 is engage with the canopy 322.

Despite the connection member 334 being simultaneously fully releasably engaged with the exterior body of the self-supporting tent structure 324 through a form fit and/or flysheet tensioning mechanisms and fully releasably engaged with the canopy 322 of the collapsible shelter 320, the collapsible shelter 320 and the self-supporting tent structure 324 remain entirely separate structures with separate structural support mechanisms. That is, the collapsible shelter 320 may rely in no part on the self-supporting tent structure 324 for its structural support and visa verse.

The releasable engagement of the canopy 322 of the collapsible shelter 320, the self-supporting tent structure 324, and the connection member 334 may improve the function of the connection member 334 as an environmental barrier and/or improve the function of the canopy 322 as an environmental barrier. However, this improvement may result from the force transfer accomplished by the connection member 334 and not from a shared or common structural support. For example, the canopy 322 of the collapsible shelter 320, the self-supporting tent structure 324, and the connection member 334 may be more resistant to the damaging effects of environmental conditions and more resistant to the intrusion of environmental conditions into the collapsible shelter 320 and/or self-supporting tent structure 324 by virtue of an increased continuous exterior shell surface area, increased anchoring mass, and/or decreased environmental condition intrusion points. Further, the extension of the releasable engagement between the canopy 322 of the collapsible shelter 320 and the connection member 334 may form a roof structure (e.g., connection member extension portion 346) extending all the way to the foot plate 316 of the collapsible shelter 320. With a roof extending substantially from the top of the arcuate opening in the canopy 322 to substantially at or near the ground, environmental conditions may be prevented from entering the collapsible shelter 320 and/or the self-supporting tent structure 324 from under the connection member 334.

The arcuate geometry and continuous engagement of the releasable engagement mechanism (e.g., arcuate connection member interface 336 and the arcuate canopy interface 338) may provide a strong and flexible connection point between the connection member interface 336 and the canopy interface 338. For example, the connection point between the connection member interface 336 and the canopy interface 338 may, by virtue of an arcuate geometry, spread the forces associated with maintaining a taut connection between the canopy 322 of the collapsible shelter 320 and the self-supporting tent structure 324 regardless of the environmental conditions acting upon the connection point. Additionally, the arcuate geometry and continuous engagement of the releasable engagement mechanism (e.g., arcuate connection member interface 336 and the arcuate canopy interface 338) may require less force and/or a more consistent force to be applied to effectuate the releasable engagement than a connection with a different geometry. The ease of connection may be further facilitated by the use of a first portion 337-1 and a second portion 337-2 of the connection member interface 336 and a first portion 339-1 and a second portion 339-2 of the canopy interface 338, since the individually actuated releasable engagement mechanisms of the first and second portions require less force, more consistent force, and less unnatural bodily contortions to actuate than a connection otherwise shaped. As described above with respect to FIG. 3A, the attachment means 326 and/or the retention plate 327 may maintain tension across the canopy interface 338 by virtue of the attachment means 326 and/or the retention plate 327. The tautly maintained arcuate archway may allow for a robust and easily actuated connection between the connection member interface 336 and the canopy interface 338.

Figure 4:
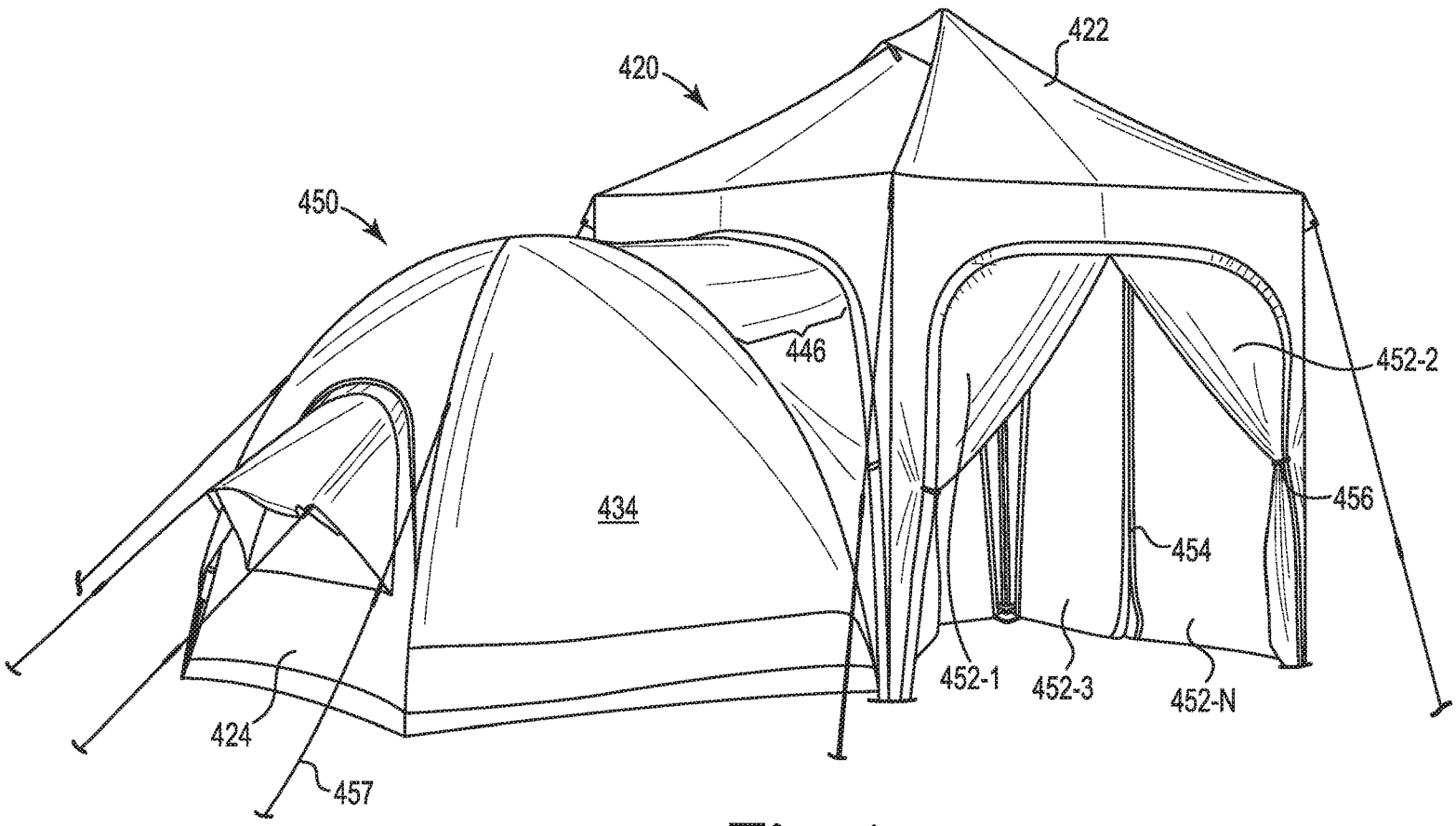
FIG. 4 is a perspective view of a shelter system having a collapsible shelter connected to a separate self-supporting tent structure via a connection member.

FIG. 4 is a perspective view of a shelter system 450 including a collapsible shelter 420 with a canopy 422 connected to a connection member 434 connected to a self-supporting tent structure 424. The canopy 422 may be connected to the connection member 434 via a releasable engagement mechanism located recessed along the portion of the canopy 422 defining an arcuate opening when not releasably engaged. The connection member 434 may be connected to the canopy 422 via a complementary releasable engagement mechanism located along the arcuate shaped edge of the connection member extension portion 446 of the connection member 434. The extension portion 446 may be a permanently joined portion of the connection member 434. Alternatively, the extension portion 446 may be a separate member (e.g., physically separate from the connection member 434). An extension portion 446 that is a separate member may include a second releasable engagement mechanism located along a second arcuate shaped edge of the extension portion 446. The second releasable engagement mechanism along the second arcuate shaped edge of the extension portion 446 may be complementary to a releasable engagement mechanism along an arcuate shaped edge of the separate connection member 434. Alternatively, the second releasable engagement mechanism along the second arcuate shaped edge of the separate extension portion 446 may be complementary to a releasable engagement mechanism along an arcuate shaped interface of a second canopy of a second collapsible shelter. The releasable engagement mechanism along an arcuate shaped interface of a second canopy of a second collapsible shelter may be substantially identical to the arcuate interface of the canopy 422 of the collapsible shelter 420. The second collapsible shelter may have a substantially identical geometry to collapsible shelter 420. Alternatively, the second collapsible shelter may have a geometry distinct from collapsible shelter 420, but also distinct from the geometry of tent structure 424.

The connection member 434 may include independent guy lines 457 attached to the connection member 457 to anchor the connection member 434 to the ground. Alternatively, the connection member 434 may include openings through the connection member 434 where a guy line 457 attached to the self-supporting tent structure 424 may pass through enroute to an anchor point on the ground.

The shelter system 450 may include a curtain and/or sidewall member 452-1 . . . 452-N. The curtain and/or sidewall member 452-1 . . . 452-N may be openable along a releasably engageable vertical edge where two portions of the curtain and/or sidewall member 452-1 . . . 452-N may join. The curtain and/or sidewall member 452-1 . . . 452-N may be suspended from the canopy within an arcuate opening defined by a portion of the canopy 422. The curtain and/or sidewall member 452-1 . . . 452-N may include a curtain and/or wall member interface having an arcuate geometry complementary to the arcuate geometry of the arcuate canopy interface. The curtain and/or wall member interface may include a releasable engagement mechanism configured to releasably engage continuously with the releasable engagement mechanism present at the arcuate canopy interface. The releasable engagement mechanism of the arcuate canopy interface releasably engaged by the arcuate curtain and/or wall member interface may be an identical or same interface configured to releasably engage with the complementary releasable engagement mechanism located along the arcuate shaped edge of the connection member extension portion 446 of the connection member 434. That is, both the connection member 434 and the curtain and/or sidewall member 452-1 . . . 452-N may be interchangeably releasably engaged with the same releasable engagement mechanism of the arcuate canopy interface.

The shelter system 450 may include an awning member (not illustrated). An awning member may include a structure configured to act as a shade providing overhang. The awning may include an independent and distinct supporting structure. The awning member may be interchangeably releasably engaged with the same releasable engagement mechanism of the arcuate canopy interface as the connection member 434, the curtain, and/or sidewall member 452-1 . . . 452-N.

In the depicted embodiment, the curtains 452-3 and 452-N are releasably coupled with a coupling mechanism, e.g., a zipper, along a vertical edge 454. When the curtains 452-3 and 452-N are releasably coupled, in the depicted embodiment in the zipped configuration, the curtains 452-3 and 452-N will remain releasably fixed in the closed position, resistant to outside elements.

In the depicted embodiment, the curtains 452-1 and 452-2 are in a drawn configuration. In the depicted embodiment the canopy 422 features curtain tie backs 456 which gatherer their respective curtain, e.g., 452-1 and 452-2, at and/or proximal to one of the vertical support legs of the collapsible shelter 420. When the curtains 452-1 and 452-2 are gathered to vertical support legs, the curtains 452-1 and 452-2 will remain releasably fixed in the drawn position.

Figure 5:
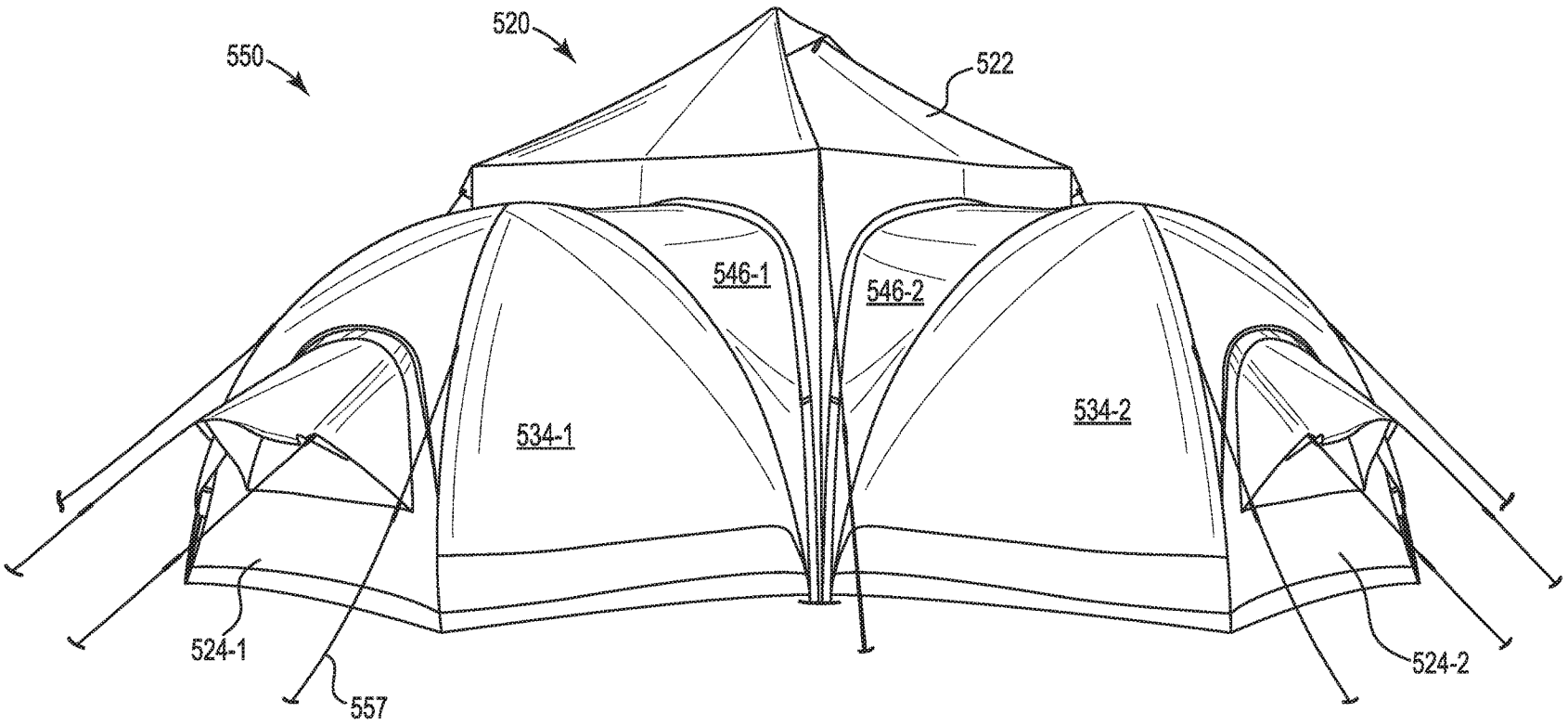
FIG. 5 is a perspective view of a shelter system having a collapsible shelter connected to a plurality of separate self-supporting tent structures via connection members.

FIG. 5 is a perspective view of a shelter system 550 including a collapsible shelter 520 with a canopy 522 connected to a plurality of connection members 534-1 and 534-2 respectively connected to a plurality of self-supporting tent structures 524-1 and 524-2. In the depicted embodiment collapsible shelter 520 has four opposing sides. Each side includes an arcuate opening defined by a portion of the canopy 522. Along each side a connection member 534-1 and 534-2 may be releasably engaged with the canopy 522 utilizing an arcuate shaped releasable engagement mechanism partially located recessed along the arcuate edge of the canopy 522 and partially located along an arcuate edge of the connection member extension 546-1 and 546-2. Further, along any of the sides a curtain member may be releasably engaged with the canopy 522 utilizing an arcuate shaped releasable engagement mechanism partially located recessed along the arcuate edge of the canopy 522 and partially located along an arcuate edge of the curtain member.

In the depicted embodiment, the connection members 534-1 and 534-2 are illustrated connected to self-supporting tent structures 524-1 and 524-2, respectively. As illustrated, the connection members 534-1 and 534-2 are form-fit tautly to the outer surfaces of the self-supporting tent structures 524-1 and 524-2. The taut form-fit between the connection members 534-1 and 534-2 and the self-supporting tent structures 524-1 and 524-2 may be maintained using a friction fit and/or by utilizing guy lines 557. The guy lines 557 may be independent guy lines attached to the connection members 534-1 and 534-2 and/or guy lines attached to the self-supporting tent structures 524-1 and 524-2, but passing through openings in the connection members 534-1 and 534-2.

Although all embodiments have been described specifically in relation to use with a collapsible shelter, it is to be understood that the shelter connection system is readily adaptable for use with other types of frames.

It will be understood that when an element is referred to as being "on," "connected to" or "coupled with" another element, it can be directly on, connected, or coupled with the other element or intervening elements may be present. In contrast, when an element is referred to as being "directly on," "directly connected to" or "directly coupled with" another element, there are no intervening elements or layers present. As used herein, the term "and/or" includes any and all combinations of a number of the associated listed items.

Although specific embodiments have been illustrated and described herein, those of ordinary skill in the art will appreciate that an arrangement calculated to achieve the same results can be substituted for the specific embodiments shown. This disclosure is intended to cover adaptations or variations of a number of embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the number of embodiments of the present disclosure includes other applications in which the above structures and methods are used. Therefore, the scope of a number of embodiments of the present disclosure should be determined with reference to the appended claims, along with the full range of equivalents to which such claims are entitled.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A shelter system, comprising:

a collapsible shelter comprising:

a number of vertical support legs extending substantially perpendicular to a collapsible truss section interconnecting the number of vertical support legs;

a canopy securable to the collapsible truss section of the collapsible shelter, wherein the canopy includes:

an arcuate interface spanning from a first vertical support leg to an adjacent second vertical support leg; and an attachment mechanism to releasably engage the canopy and arcuate interface with the first vertical support leg; and a connection member to connect the canopy to a separate self-supporting tent structure by engaging with the arcuate interface, wherein the connection member includes a flysheet portion separate from the separate self-support tent structure.

2. The shelter system of claim 1, wherein the canopy includes a leg spanning portion to span the canopy from the collapsible truss section to a distal end of a corresponding vertical support leg of the number of vertical support legs, and the attachment mechanism to releasably engage the canopy and arcuate interface to the distal end of the first vertical support leg.

3. The shelter system of claim 2 wherein the number of vertical support legs each include a foot plate at the distal end of the corresponding vertical support leg, and the foot plate has an area larger than an area of the corresponding vertical support leg;

the attachment mechanism to releasably engage the canopy and arcuate interface to the foot plate and provide tension to the canopy along the leg spanning portion when the shelter is erect.

4. The shelter system of claim 1, wherein the arcuate interface is releasably engageable with the connection member continuously along the arcuate interface.

5. The shelter system of claim 1, wherein a second connection member is configured to connect the canopy, having a second arcuate interface spanning from the adjacent second vertical support leg to an adjacent third vertical support leg, to a second, separate self-supporting tent structure by engaging with second connection member with the second arcuate interface.

6. The shelter system of claim 1, wherein each side of the canopy includes an arcuate interface between adjacent vertical support legs.

7. The shelter system of claim 6, wherein each arcuate interface is releasably engageable with the connection member.

8. The shelter system of claim 1, wherein the shelter system has a first geometry and the separate self-supporting tent structure has a second distinct, dome geometry, wherein a foot plate to the first geometry is releasably engageable to a distal end of a vertical support leg spanning portion of the canopy.

9. A shelter system, comprising:

a collapsible shelter comprising:

a number of vertical support legs extending substantially perpendicular to a collapsible truss section interconnecting the number of vertical support legs;

a canopy securable to a first end of each of the number of vertical support legs distal to the collapsible truss section by an attachment mechanism that is configured to releasably engage with the canopy and the vertical support legs, wherein the canopy includes:

an arcuate interface spanning between the first end, distal to the collapsible truss section, of a first leg of the number of vertical support legs and the first end, distal to the collapsible truss section, of a second leg of the number of vertical support legs; and a connection member, releasably engageable continuously along the arcuate interface of the canopy, providing a connection to a separate self-supporting tent structure wherein the connection member includes a flysheet portion securable to the separate self-supporting tent structure.

10. The shelter system of claim 9, wherein the separate self-supporting tent structure is a dome tent supported by a number of supporting rods independent from the shelter, and wherein a distal end of a vertical support leg spanning portion of the canopy is securable to the first end of the first leg of the collapsible shelter.

11. The shelter system of claim 9, wherein the canopy includes a first plurality of releasable engagement mechanisms spanning the arcuate interface.

12. The shelter system of claim 11, wherein the connection member includes a second plurality of releasable engagement mechanisms complementary to the first plurality of releasable engagement mechanisms.

13. The shelter system of claim 12, wherein the first plurality of releasable engagement mechanisms and the second plurality of releasable engagement mechanisms include zipper mechanisms.

14. The shelter system of claim 9, wherein the flysheet portion of the connection member comprises a water repellant material configured to protect an inner skin of the separate self-supporting tent structure from water permeation.

15. A shelter system comprising:

a canopy comprising:

a first portion configured to be supported by a collapsible frame including a number of vertical support legs extending substantially perpendicular to a collapsible truss interconnecting the number of vertical support legs, a second portion including an interface configured to releasably engage a connection member; and a third portion including an attachment mechanism to secure the canopy to a first vertical support; and the connection member comprising:

a flysheet portion, distinct from and outside of a fabric shell of a self-supporting tent structure separate from the shelter, configured to fit over a portion of the fabric shell of the self-supporting tent structure, and an extension portion configured to releasably engage the interface.

16. The shelter system of claim 15, wherein:

the interface includes at least four separate and opposing interfaces; and the connection member is permanently joined to the flysheet.

17. The shelter system of claim 15, further comprising a sidewall member configured to releasably engage the interface and form an openable barrier between adjacent vertical support legs of the shelter.

18. The shelter system of claim 15, wherein the attachment mechanism is configured to attach to the first portion to a distal end of a pair of adjacent vertical support legs to form an arcuate opening between the pair of adjacent vertical support legs.

19. The shelter system of claim 18, wherein the interface comprises at least two releasably engageable portions located along the periphery of the arcuate opening.

20. The shelter system of claim 19, wherein the extension portion is configured to releasably engage continuously along an entire length of the at least two releasably engageable portions of the interface.

* * * * *